United States Patent [19]

Durst et al.

[11] Patent Number: 4,977,404

[45] Date of Patent: Dec. 11, 1990

[54] REMOTE CONTROL TRANSMITTER FOR EMITTING CONTROL COMMANDS

[75] Inventors: Klaus Durst, Bruchsal; Gerd Reime, Wurmberg, both of Fed. Rep. of Germany

[73] Assignee: Nokia Unterhaltungselektronik, Pforzheim, Fed. Rep. of Germany

[21] Appl. No.: 442,127

[22] Filed: Nov. 28, 1989

[51] Int. Cl.[5] ..... G08C 19/12; H01H 35/02

[52] U.S. Cl. ..... 341/176; 200/DIG. 29; 200/61.47; 331/65

[58] Field of Search ..... 341/176; 340/689, 669, 340/573–576, 311.1, 825.44, 825.04; 455/100; 200/61.52, DIG. 29, 61.47; 33/366; 331/65

[56] References Cited

U.S. PATENT DOCUMENTS 4,216,467 8/1980 Colston ..... 341/176 X 4,829,285 5/1989 Brand et al. ..... 340/689 X

*Primary Examiner*—Glen R. Swann, III

*Assistant Examiner*—Thomas J. Mullen, Jr.

*Attorney, Agent, or Firm*—Peter C. Van Der Sluys

[57] ABSTRACT

A remote control transmitter contains on a circuit board (3), which is rigidly connected to the transmitter housing (1) of the remote control transmitter, a positional-deviation switch configuration (17), which in the event of an angular deviation of the circuit board (3) and thus of the remote control transmitter beyond a particular trigger angle ($a_o$) from a particular given or instantaneously determined reference operating position generates an output signal designating the direction of the positional deviation. In a signal converter (5) of the remote control transmitter, this direction-dependent output signal is converted as a control command into a transmission signal, and emitted via a transmitter element (4) of the remote control transmitter to a remotely controlled electrical appliance. By means of swivel movements of the remote control transmitter from the wrist of the user operating the remote control transmitter, different control commands to the remotely controlled appliance are generated in this way in the remote control transmitter.

20 Claims, 4 Drawing Sheets

REMOTE CONTROL TRANSMITTER FOR EMITTING CONTROL COMMANDS

BACKGROUND OF THE INVENTION

1. Field of the Invention

The invention relates to a remote control transmitter, whose transmitter housing contains transmitter elements for emitting control commands selected at an entry device of the transmitter, by means of transmission signals formed in a signal converter of the transmitter.

2. Description of the Prior Art

Remote control transmitters of this type serve for controlling electrical equipment over a wireless link, especially for controlling photo-electric equipment such as slide or film projectors, or for controlling appliances of the consumer electronics industry (TV sets or video recorders, for example). Remote control transmitters of this type are familiar, for example, from the periodical "Funkschau" 1978, No. 9, pp 405–407, or the periodical "Funkschau" 1978, No. 20, pp 963–966.

The conventional remote control transmitters contain buttons on the operator side of a transmitter housing as the entry device. By pressing individual buttons, the user of the remote control transmitter selects control commands for setting or altering particular operating states of an electrical appliance controlled with the remote control transmitter. In a signal converter of the remote control transmitter, the control commands called up with the buttons pressed are converted into transmission signals and sent to the electrical appliance in question by an infra-red transmitter element.

The unpractised user of a remote control transmitter of this type must frequently refresh his memory during use by reading the designations for the individual buttons in order to ascertain which buttons he must press for a particular command. Even when the number of buttons is relatively small, this is laborious and time-consuming for him. In addition, he is often uncertain whether he has actually pressed the button assigned to the control command involved.

SUMMARY OF THE INVENTION

The task of the invention is to design a remote control transmitter, whose transmitter housing contains transmitter elements for emitting control commands selected at an entry device of the transmitter, by means of transmission signals formed in a signal converter of the transmitter, so that the handling of the remote control transmitter is substantially simplified, even for the unpractised user, at least for adjusting important operating states or operating functions of the appliance being remotely controlled with the remote control transmitter. This task has been achieved by the invention by using an entry device that is a positional-deviation switch configuration coupled to the transmitter housing, which in the event of an angular position deviation of the transmitter housing from a certain instantaneous reference position of the transmitter housing going beyond a certain amount of angle, generates an output signal designating the direction of angular position deviation as a control command capable of being passed to the signal converter.

The invention is based on the experience that individual procedures of daily life can be designated by certain hand movements. For example, magnification of an event or a forward-oriented step-by-step progress or a forward-going browse is designated by a hand movement to the right or upwards. If, for example, browsing in the function levels of a remotely controlled appliance is assigned to the upward or downward movement of the remote control transmitter held in the hand of the user, and this function level is displayed in the remotely controlled appliance, the user of a remote control transmitter in accordance with the invention can browse in the function levels of the remotely controlled appliance without observing the remote control transmitter itself, simply by hand movements directed upwards or downwards. In the same way, by moving his hand to the right or the left (which will be accompanied by an involuntary turning movement in the axis of the hand), he can switch on a forward or backward run, or amplify or damp events, without having to direct his attention to the remote control transmitter he is using. In addition, the operation of a remote control transmitter in accordance with the invention requires only one hand, so that the user of a remote control transmitter of this type has his other hand free for other activities while he is using the transmitter.

It is especially advantageous to use gravity switches for determining positional deviations of the transmitter housing of the remote control transmitter, since the Earth's gravitation represents a force field aligned on the center of the Earth and defined for every human activity. It is, however, also possible to detect a swivel movement of a remote control transmitter held in a user's hand by means of acceleration switches, with which the positional-deviation switch configuration of the remote control transmitter is fitted, and to derive herefrom control commands for remote control of an electrical appliance. In a further version of the invention, the positional-deviation switch configuration of the remote control transmitter contains sensors, which provide directionally dependent measurement of the intensity of a particular radiation or force field, and represent it by an electrical signal. If these signals remain constant beyond a certain period, they designate (in accordance with one version of the invention) a rest position of the remote control transmitter, acting as a reference operating position for it. In a further version of the invention, values determined at a certain moment for these signals likewise form the reference values for a rest position of the remote control transmitter. If the position of the remote control transmitter is altered from this rest position by a swivel movement of the remote control transmitter held in the hand, the direction of the swivel operation is determined from the new output signals of the sensors, and from this the associated control commands are decoded. A radiation or force field of this type is, for example, the Earth's magnetic field or the radiation field of a particular radiation source, e.g. a source of an electromagnetic radiation.

DESCRIPTION OF THE DRAWINGS

The invention is explained in more detail below as exemplified by advantageous implementation versions. In the associated drawings

DETAILED DESCRIPTION OF THE PREFERRED EMBODIMENT

Figures 1A, 1B, 1C, 2:
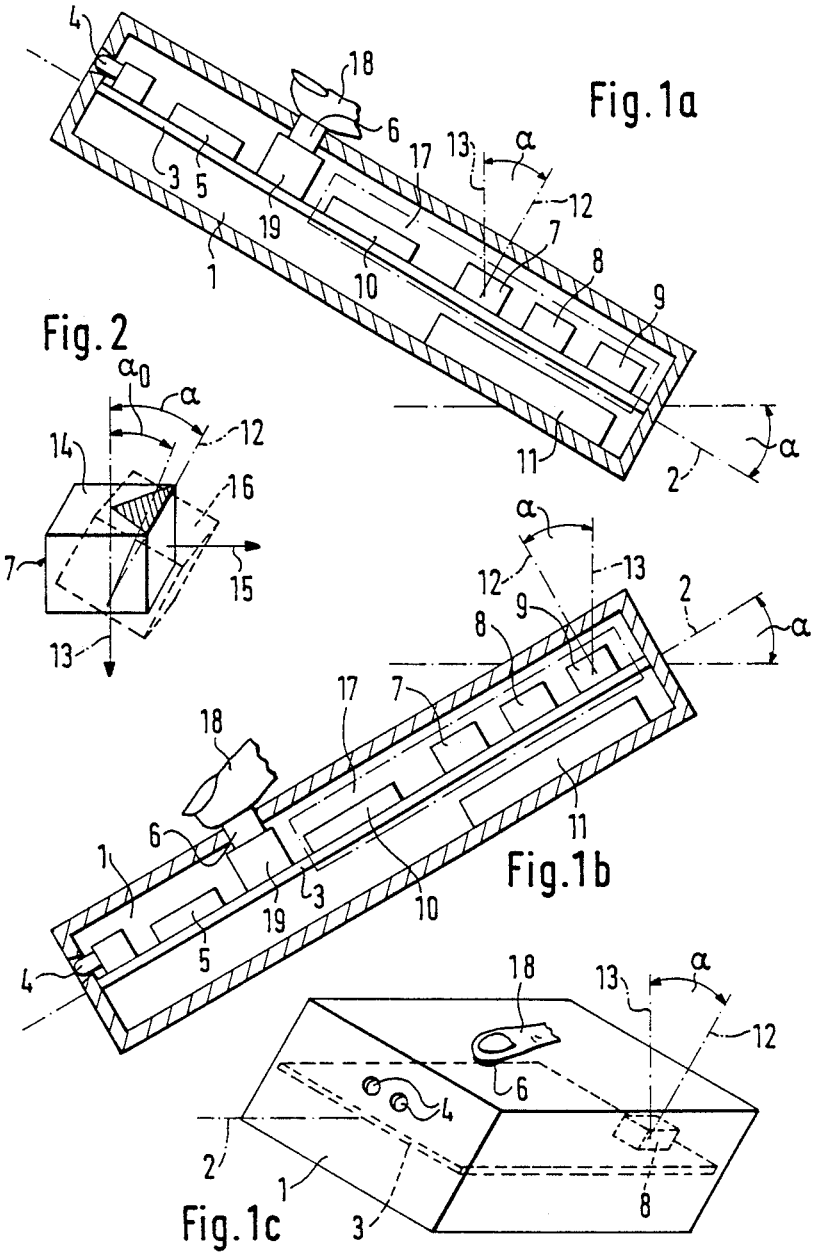
FIG. 1*a*, FIG. 1*b* show a diagrammatic side view of a longitudinal section through an operated remote control transmitter, in each case at an angle to the horizontal.
FIG. 1*c* shows a diagrammatic representation of an operated remote control transmitter swivelled in the horizontal and while swivelled simultaneously turned around its main axis.
FIG. 2 shows a diagrammatic representation of a gravity switch in various positions.

FIGS. 1*a* and 1*b* show in a diagrammatic representation the side view of a remote control transmitter, which in the case of FIG. 1*a* is swivelled by an inclination angle (a) upwards out of its horizontal position, and in the case of FIG. 1*b* is swivelled downwards out of a horizontal position by the inclination angle (a). The transmitter housing (1) is drawn cut open along a vertical plane through the main axis (2) of the remote control transmitter, so that the important components of the remote control transmitter can be diagrammatically represented. A board (3) linked immovably to the transmitter housing accommodates transmitter elements (4) protruding through the transmitter housing, a direction signal converter (5), a pushbutton (6), several gravity switches (7, 8, 9) and a circuit configuration (10) associated with these. For power supply, the remote control transmitter is provided with a battery (11).

The gravity switches (7, 8, 9) exhibit a rest position, which applies when their main axis (12) lies parallel to the direction of gravitation (13). If one of the gravity switches (e.g. gravity switch (7)) is swivelled out of its rest position (14) in a certain direction (15) into a position (16) inclined by an angle (a) in relation to the rest position (14), when the inclination angle (a) is greater than a trigger angle ($a_o$), as represented diagrammatically in FIG. 2, then this gravity switch will generate an output signal. If several of these gravity switches (7, 8, 9) are arranged on the board (3) of the remote control transmitter in such a way as to ensure that their effective directions (15) point in different directions, a positional-deviation switch configuration (17) formed of this type of switch can identify by means of its output signals a swivelling of the remote control transmitter out of its horizontal position, which represents the reference operating position of the remote control transmitter in relation to all swivel movements for controlling a remotely controlled electrical appliance. From the output signals generated by the gravity switches of the remote control transmitter, the direction signal converter (which also belongs to the positional-deviation switch configuration (17)) forms a signal designating the direction of the positional deviation from the horizontal reference operating position of the remote control transmitter; this signal is converted by the signal conversion circuit (5) into a transmission signal as a control command for the transmitter elements (4).

For remote control of an electrical appliance, the user of the remote control transmitter holds this remote control transmitter in one hand, so that with the thumb (18) of this hand he can operate the pushbutton (6) of an on/off switch (19) of the remote control transmitter. When this pushbutton (6), which protrudes from the transmitter housing (1), is pressed, the positional-deviation switch configuration (17) of the remote control transmitter is switched on, so that it can detect a swivel position of the remote control transmitter held in the hand due to a swivel movement of the user's hand, and can form a control command therefrom. When the remote control transmitter held in a horizontal position is swivelled to the right or the left, the remote control transmitter is turned around its main axis (2) by an involuntary additional turn of the hand when the hand swivels, resulting in a sideways inclination of the transmitter housing (1) in relation to the horizontal, as shown in FIG. 1*c*, for example. In this figure the dotted lines show the board (3) surrounded by the transmitter housing (1) of the remote control transmitter, and the gravity switch (8) located on this board; this switch is operative in the lateral inclination from the horizontal of the transmitter housing as shown in FIG. 1*c*, and generates an output signal if the inclination angle (a) is greater than the trigger angle ($a_o$).

If when the pushbutton (6) is pressed none of the gravity switches (7, 8, 9) of the remote control transmitter generates an output signal, the direction signal converter (10) determines herefrom that the remote control transmitter is in its reference operating position, i.e. is in a horizontal position, and then generates an output signal assigned to the rest position of the remote control transmitter; this signal is likewise used as a control command, and passed to the signal converter (5) for transmission to the remotely controlled appliance. In order to represent the four directions of inclination (transmitter housing turned upwards or downwards, or transmitter housing turned to the right or left around its main axis), in the implementation example shown the positional-deviation switch configuration (17) of the remote control transmitter depicted in FIGS. 1*a* to 1*c* contains four gravity switches, of which the three gravity switches (7, 8, 9) are diagrammatically represented.

In a different implementation example, the positional-deviation switch configuration (17) contains a fifth gravity switch, which, in the case of a position whose angular deviation of the main axis of the gravity switch from the gravitational direction (13) is smaller than the trigger angle ($a_o$) of the other four gravity switches, generates an output signal independently of direction, and thus designates a position around the rest position of the remote control transmitter.

In a further implementation example, the elements detecting the inclination of the remote control transmitter as compared to a reference operating position of the remote control transmitter are not gravity switches, but direction-dependent sensors which detect the angle deviating from the gravitational direction and generate an electrical output signal dependent on the amount of the angular deviation. In this case the direction signal converter (10) generates above a certain angular deviation a direction-dependent output signal, so that the inclination sensors, in conjunction with the switching characteristic of the direction signal converter (10) again represent gravity switches. In this case, the switching hysteresis most favourable for remote control by a swivel movement of the remote control transmitter can be set at the positional-deviation switch configuration (17).

Figure 3:
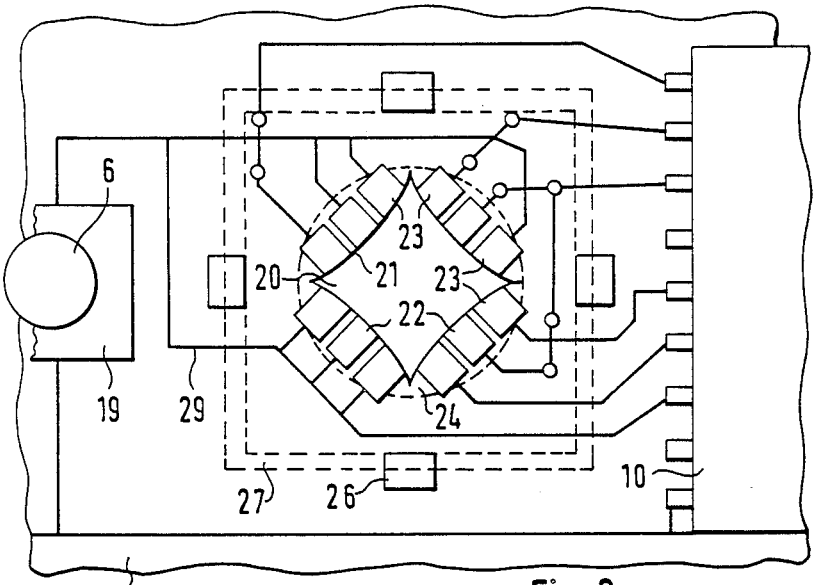
FIG. 3 shows an excerpt from a circuit board of a remote control transmitter with a multiple gravity switch switched by a ball.
Figure 4A:
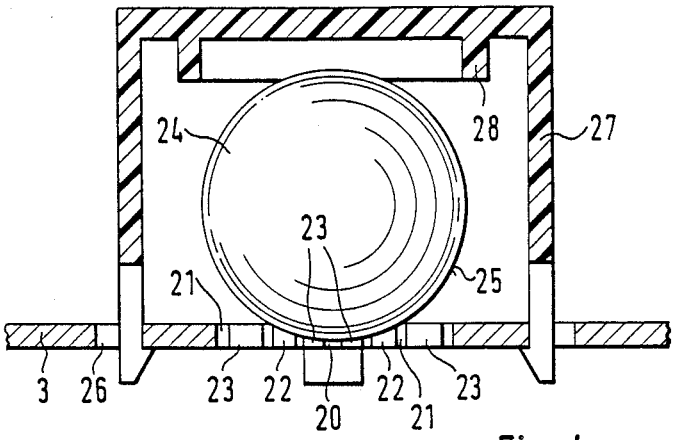
FIG. 4*a*, FIG. 4*b* show a side view of a multiple gravity switch as shown in FIG. 3, in a horizontal and an inclined position of the circuit board.

In the following FIGS. (3 to 6), some implementation examples for a positional-deviation switch configuration (17) of remote control transmitters with gravity switches are explained in more detail. For the implementation example shown in FIGS. 3, 4*a*, FIG. 3 shows an excerpt of a circuit board (3) at the location of the positional-deviation switch configuration (17) of a remote control transmitter. The circuit board (3) contains at this point an axis-symmetrical recess (20), whose edges (21) are cambered slightly into the recess (20). At each edge a narrower contact element (22) is fitted in the centre, with a wider contact element (23) to the right and left of it. As shown by the dotted lines in the drawing, a ball (24) is mounted in the horizontal board. The highly conductive surface (25) (FIGS. 4*a* and 4*b*), is pivoted in this position on the central contact elements (22) of the edges (21) in the recess (20), thus providing electrical connection between the central contact elements (22). The ball (24) thus forms, together with the central contact elements (22) a gravity switch for designating an approximately horizontal rest position of the remote control transmitter. The four corners of the square recess (20) in the circuit board (3) point in the four directions in which the other four gravity switches become operative. The contact elements (23) at the corners of each pair of meeting edges (21) of the recess each form, together with the ball (20) another gravity switch, whose contact elements in the rest position of the remote control transmitter are not electrically connected by the ball. Not until the remote control transmitter is tilted in one of the directions in which the corners of the recess (20) point and in which the centre of gravity of the ball (24) passes through the vertical plane through the support points of the ball at the edge (21) of the recess (20), will the ball roll along the two edges (21) forming the tip in the direction of inclination of the remote control transmitter until it reaches a position limited by a stopper, in which the ball connects the two contact elements (23) located closest to the tip. A position of this kind is depicted in FIG. 4*b* for an upward swivel of the remote control transmitter.

Figure 4B:
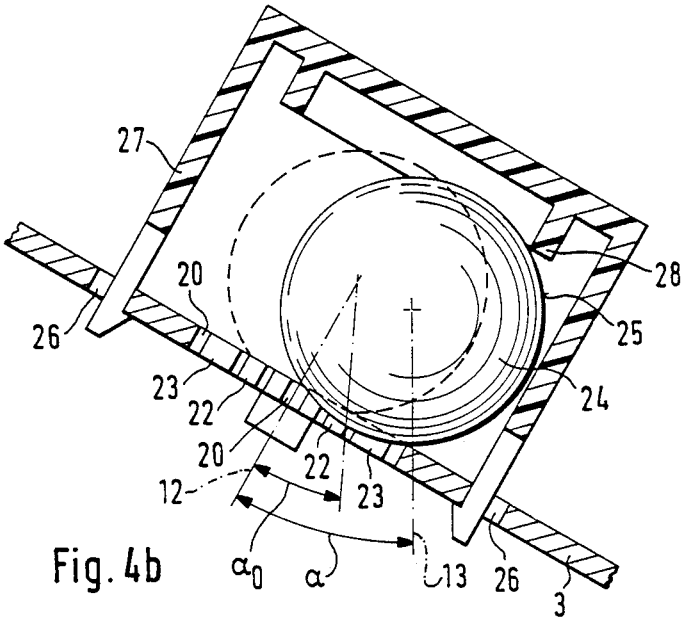

To protect the ball (24) and to limit its travel on the edges (21) of the recess (20), a cover cap (27) is fitted in recesses (26) of the board (3); this cap is intimated by the dotted line in FIG. 3, and shown cut open from the side in FIGS. 4*a* and 4*b*. The cap (27) contains a stopper edge (28) which limits the travel of the ball (24) and guides it as necessary. The cambered design of the edges (21) of the recess (20) also contributes to better guidance for the ball (24) in the individual effective directions. The one contacts of the five gravity switches are (in the implementation example shown) linked together with the on/off switch (19) of the remote control transmitter over electrical lines (29); the other contact elements of these gravity switches are linked individually to a direction signal converter (10).

FIG. 4*a* again shows a side view of the position of the ball (24), which is the common switching element of the positional-deviation switch configuration (17) formed of the five gravity switches, depicted in the horizontal rest position of the remote control transmitter, in which the main axis (12) of the switch configuration shown runs parallel to the gravitational direction (13). In FIG. 4*b*, the switch configuration shown in FIG. 4*a* is depicted in a position of the remote control transmitter tilted upwards by the angle (a), with the ball (24) lying flush against the stopper edge (28) of the cover cap (27). The inclination angle (a) is greater than the trigger angle ($a_o$), in which the centre of gravity of the ball (24) just passes through the vertical plane through the support points of the ball on the edges (21) of the recess (20) in the board (3).

Figure 5:
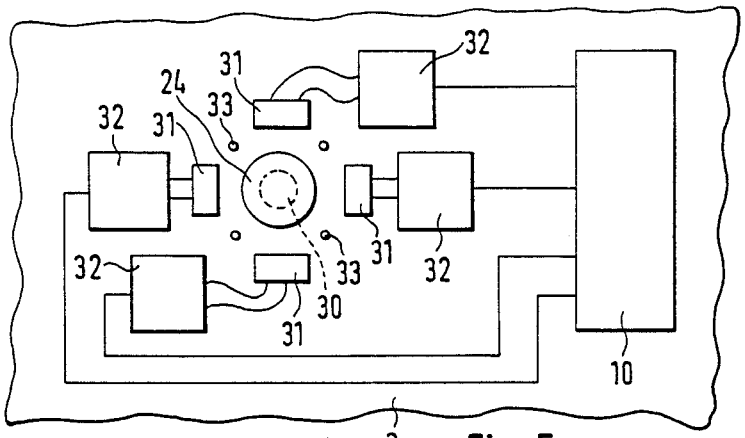
FIG. 5 shows a plane view of a diagrammatically represented excerpt of a circuit board of a remote control transmitter with dampable oscillators as gravity switches.

The excerpt of a circuit board (3) of a remote control transmitter shown in FIG. 5 contains a positional-deviation switch configuration (17), in which likewise a ball (24) is mounted in a recess (30) of the circuit board. In the drawing, the circular recess (30) is covered by the ball (24) and depicted with dotted lines. Around the ball (24), four oscillator coils (31) are arranged in a ring configuration on the circuit board (3), i.e. looking at the opened transmitter housing one oscillator coil in front of and behind, and one to the left and to the right of the recess (30) in the circuit board (3) of the remote control transmitter. Each of these oscillator coils (31) is connected to its own associated electrical oscillator (32). The oscillators (32) are adjusted so that in the rest position of the ball (24), in which it is pivoted in the recess (30), they generate an electrical oscillation. However, as soon as the ball approaches one of the oscillator coils, and (due to an inclination of the transmitter housing) comes into contact with it, the oscillation will cease. Guide rods (33) located on the circuit board ensure that the ball (24) approaches only one oscillator coil when the remote control transmitter is tilted, so that the oscillation of only one oscillator is interrupted. The oscillators (32) are connected to a direction signal converter (10), which generates an output signal dependent on the inclination angle of the remote control transmitter, for transmitting to a remotely controlled electrical appliance. The ball (24) and the oscillator coils (31) are protected and secured by a cover cap not shown in the drawing.

Figure 6:
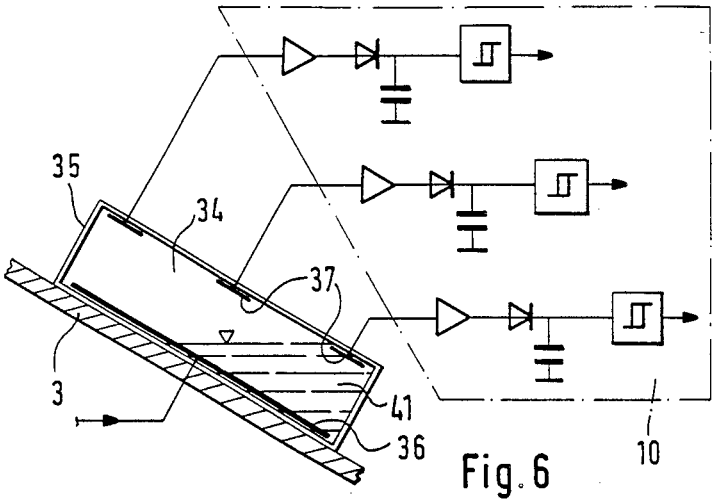
FIG. 6 shows a diagrammatic representation of a positional-deviation switch configuration with a multi-contact liquid-level switch as a gravity switch.

FIG. 6 provides a diagrammatic representation of a positional-deviation switch configuration of a remotee control transmitter, which contains a liquid-level switch (34) as a gravity switch. This liquid-level switch is located in a positionally stable configuration attached to a circuit board (3) in the (not shown in detail) transmitter housing of a remote control transmitter, and contains at the bottomm of the switch housing (35) a large-area plate-shaped central contact (36). At the covr wall of the switch housing (35) opposite the bottom, for example, four contact elements (37) considerably smaller in area are arranged in a ring configuration distributed around the edge. The switch housing contains a non-wetting, electrically conductive liquid (41), in a quantity ensuring that it covers only one of the contact elements (37) when the circuit board (3) is in a vertical position. AS from a certain inclination of the circuit board (3) from the horizontal, corresponding to a trigger angle ($a_o$), the conductive liquid wets the contact element (37), which is assigned to the direction of inclination of the circuit board (3) and thus to the direction of inclination of the remote control transmitter, thus establishing a conductive connection between the central contact (36) and this contact element (37), so that the gravity switch thus formed is conductively closed. The four contact elements (37) of the liquid-level switch (34), of which only three are shown in the drawing, are connected to a direction signal converter (10), which forms from the signals transmitted via the contacts of the liquid-level switch a direction-dependent output signal, which is transmitted by the remote control transmitter in a transmission signal as a control command to a remotely controlled electrical appliance. Mercury is especially suitable as a conductive, non-wetting liquid (41) in the switch housing (35), exhibiting as it does high flow damping properties due to its inertia and weight. If an easier-flowing liquid is used, the switch housing (35) of the liquid-level switch (34) contains flow-damping agents not shown in detail.

In the case of an implementation example of a remote control transmitter corresponding to FIGS. 1*a* and 1*b*, the positional-deviation switch configuration (17) contains, instead of gravity switches (7, 8, 9) several acceleration switches, which for the sake of simplicity are identified with the same reference characters as the gravity switches in FIGS. 1*a* to 1*c*. In the event of an acceleration above a certain acceleration amount and in a particular acceleration direction for which the acceleration switch is designed, the acceleration switches generate an output signal. Due to an appropriate configuration of the acceleration switches (7, 8, 9) with an alignment in the four main directions of movement of the remote control transmitter (upwards, downwards, left and right), these acceleration sensors use their output signals to announce the swivel-movement status of the remote control transmitter to a direction signal converter (10), which from these output signals generates a direction-dependent output signal for transmission as a control command to a remotely controlled electrical appliance.

Figure 7:
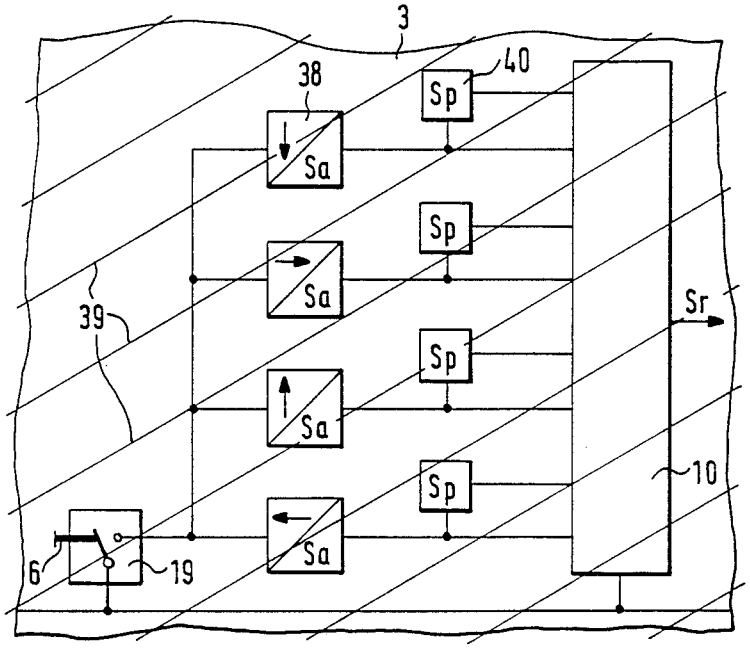
FIG. 7 shows an excerpt of a circuit board of a remote control transmitter with field-dependent sensors of a positional-deviation switch configuration.

FIG. 7 shows in diagrammatic form a positional-deviation switch configuration (17) of a remote control transmitter, containing sensors (38) which respond to a particular force or radiation field. The field lines (39) of such a force or radiation field are shown diagrammatically in FIG. 7, with the intensity of the field being direction-dependently measured by the sensors (38), and a corresponding analog signal (Sa) being outputted at their output. In implementation example illustrated, the sensors (38) are arranged in four different effective directions, so that when measuring they generally output different analog signals (Sa). Analog value memories (40) and a direction signal converter (10) are connected to the output of the sensors (38). The outputs of the analog value memories (40) are also connected to the direction signal converter (10).

To output a control command, the user of the remote control transmitter first presses the button (6) of the on/off switch (19) of the remote control transmitter (not shown in detail), and while keeping the pushbutton (6) depressed performs the desired swivel movement of the remote control transmitter.

When the remote control transmitter is switched on by pressing the button (6) of the switch (19), the analog signals (Sa) outputted by the sensors (38) are stored in the analog value memories (40). These then serve the direction signal converter (10) as a reference value for the subsequent swivel movement. From these reference values the direction signal converter determines in a logical process the direction of the swivel movement from the analog values outputted by the sensors (38) after being stored in analog value memories (40), and outputs a corresponding direction-dependent output signal (Sr) at its output, which is then transmitted as a control command to an electrical appliance remotely controlled by the remote control.

What is claimed is:

1. Remote control transmitter, whose transmitter housing contains transmitter elements for emitting control commands selected at an entry device of the transmitter, by means of transmission signals formed in a signal converter of the transmitter, the distinguishing feature being that the device is a positional-deviation sensing means (17) coupled to the transmitter housing (1), which in the event of an angular position deviation (a) of the transmitter housing from a certain instantaneous reference position of the transmitter housing to a predetermined angle ($a_o$), generates an output signal designating the direction of angular position deviation as a control command capable of being passed to the signal converter (5).

2. Remote control transmitter in accordance with claim 1, the distinguishing feature being that the positional-deviation sensing means (17) contains several switches (7, 8, 9) each adapted to sence a particular direction of the angular position deviation (a), and generate an output signal only when there is an angular position deviation in the particular direction sensed by the switch.

3. Remote control transmitter in accordance with claim 2, the distinguishing feature being that the switches are gravity switches (7, 8, 9), which are coupled to the transmitter housing (1), and whose reference position direction is the direction of the Earth's gravitation (13), and which generate a particular output signal in the event of an angular position deviation (a) from the reference position direction.

4. Remote control transmitter in accordance with claim 3, the distinguishing feature being that the gravity switches are contact elements (22, 23) located on a plate (3), linked in a positionally stable configuration to the transmitter housing (1); in the event of an angular deviation (a) of the transmitter housing from a horizontal reference position of the transmitter housing, these contact elements are electrically connected directly or by a heavy body moved out of its rest position by the alteration in angular position of the transmitter housing.

5. Remote control transmitter in accordance with claim 4, the distinguishing feature being that the heavy body is a ball (24) having a highly conductive surface (25), mounted in a recess (20, 30) of the plate (3).

6. Remote control transmitter in accordance with claim 5, the distinguishing features being that the contact elements (22, 23, 31) of four gravity switches are arranged in a ring configuration around the recess (20, 30) for the ball (24) on the plate (3), and that around the recess guide elements (21, 33) are fitted, which guide the movement of the ball towards a contact element.

7. Remote control transmitter in accordance with claim 3, the distinguishing features being that the gravity switches comprising an electric oscillator (32), whose oscillator coils (31) are located on a plate (3) linked in a positionally stable configuration to the transmitter housing (1), and that not less than one heavy body coupled to the transmitter housing is provided, which in the event of an angular deviation (a) of the transmitter housing from a horizontal reference position of the transmitter housing moves from a rest position towards the oscillator coil and interrupts the oscillator vibration by damping the oscillator coil.

8. Remote control transmitter in accordance with claim 3, the distinguishing feature being that the gravity switches are liquid-level switches located on a plate (3) linked in a positionally stable configuration to the transmitter housing (1); at a certain inclination (a) of the liquid-level switches, their liquid provides an electrically conductive link between the contacts.

9. Remote control transmitter in accordance with claim 8, the distinguishing feature being that the positional-deviation switch configuration (17) contains a single liquid-level switch (34), which contains not less than four inclination contacts (37), which are arranged in a ring configuration around a central contact (36) so as to ensure that at a certain inclination angle ($a_o$) in a certain direction only one inclination contact is electrically linked to the central contact by the liquid.

10. Remote control transmitter in accordance with claim 2, the distinguishing feature being that the positional-deviation sensing means (17) contains acceleration switches, which in the event of a movement of the transmitter housing (1) in a particular direction in relation to a main axis (2) of the transmitter housing generate an output signal designating the direction of said movement.

11. Remote control transmitter in accordance with claim 2, the distinguishing feature being that the positional-deviation sensing means (17) contains sensors (38) which detect the direction of field lines (39) of a radiation or force field, and are adapted to sence different directions of angular deviation in relation to a main axis (2) of the transmitter housing (1), and whose output signals (Sa) at a particular movement designate the rest position of the transmitter housing at this moment as a reference position of the transmitter housing.

12. Remote control transmitter in accordance with claim 1, the distinguishing feature being that the positional-deviation sensing means contains gravity switches (7, 8, 9), which are coupled to the transmitter housing (1), and whose reference position direction is the direction of the Earth's gravitation (13), and which generate an output signal in the event of a particular angular position deviation (a) from the reference position direction.

13. Remote control transmitter in accordance with claim 12, the distinguishing feature being that the gravity switches are contact elements (22, 23) located in a plate (3) linked in a positionally stable configuration to the transmitter housing (1); in the event of an angular deviation (a) of the transmitter housing from a horizontal reference position of the transmitter housing, these contact elements are electrically connected directly or indirectly by a heavy body moved out of its rest position by the alteration in angular position of the transmitter housing.

14. Remote control transmitter in accordance with claim 13, the distinguishing feature being that the heavy body is a ball (24) having a highly conductive surface (25), mounted in a recess (20, 30) of the plate (3).

15. Remote control transmitter in accordance with claim 14, the distinguishing features being that the contact elements (22, 23, 31) of four gravity switches are arranged in a ring configuration around the recess (20, 30) for the ball (24) on the plate (3), and that around the recess guide elements (21, 33) are fitted, which guide the movement of the ball towards a contact element.

16. Remote control transmitter in accordance with claim 12, the distinguishing features being that the gravity switches comprise an electric oscillator (32), whose oscillator coils (31) are located on a plate (3) linked in a positionally stable configuration to the transmitter housing (1), and that not less than one heavy body coupled to the transmitter housing is provided, which in the event of an angular deviation (a) of the transmitter housing from a horizontal reference position of the transmitter housing moves from a rest position towards the oscillator coil and interrupts the oscillator vibration by damping the oscillator coil.

17. Remote control transmitter in accordance with claim 12, the distinguishing feature being that the gravity switches are liquid-level switches located on a plate (3) linked in a positionally stable configuration to the transmitter housing (1); at a certain inclination (a) of the liquid-level switches, their liquid provides an electrically conductive link between the contacts.

18. Remote control transmitter in accordance with claim 17, the distinguishing feature being that the positional-deviation sensing means (17) contains a single liquid-level switch (34), which contains not less than four inclination contacts (37), which are arranged in a ring configuration around a central contact (36) so as to ensure that at a certain inclination angle ($a_o$) in a certain direction only the inclination contact is electrically linked to the central contact by the liquid.

19. Remote control transmitter in accordance with claim 1, the distinguishing feature being that the positional-deviation sensing means (17) contains acceleration switches, which in the event of a movement of the transmitter housing (1) in a particular direction in relation to a main axis (2) of the transmitter housing generate an output signal designating the direction of said movement.

20. Remote control transmitter in accordance with claim 1, the distinguishing feature being that the positional-deviation sensing means (17) contains sensors (38) which detect the direction of field lines (39) of a radiation or force field, and are adapted to sense different directions of angular deviation in relation to a main axis (2) of the transmitter housing (1), and whose output signals (Sa) at a particular moment designate the rest position of the transmitter housing at this moment as a reference position of the transmitter housing.

* * * * *

UNITED STATES PATENT AND TRADEMARK OFFICE

CERTIFICATE OF CORRECTION

PATENT NO. : 4,977,404

DATED : December 11, 1990

INVENTOR(S) : Klaus Durst and Gerd Reime

It is certified that error appears in the above-identified patent and that said Letters Patent is hereby corrected as shown below:

Column 9, line 5, please delete "8" and insert --1--; and at line 6, please delete "switch configuration" and insert --sensing means--.

Signed and Sealed this

Twenty-third Day of June, 1992

*Attest:*

DOUGLAS B. COMER

*Attesting Officer*

*Acting Commissioner of Patents and Trademarks*